US011873545B2

(12) United States Patent
Dolman et al.

(10) Patent No.: US 11,873,545 B2
(45) Date of Patent: Jan. 16, 2024

(54) EROSION AND CORROSION RESISTANT WHITE CAST IRONS

(71) Applicant: Weir Minerals Australia LTD, Artarmon NSW (AU)

(72) Inventors: Kevin Francis Dolman, Epping (AU); Timothy Justin Lucey, St. Clair (AU)

(73) Assignee: Weir Minerals Australia Ltd.

( * ) Notice: Subject to any disclaimer, the term of this patent is extended or adjusted under 35 U.S.C. 154(b) by 607 days.

(21) Appl. No.: 16/312,595

(22) PCT Filed: Jun. 26, 2017

(86) PCT No.: PCT/AU2017/050650

§ 371 (c)(1),
(2) Date: Dec. 21, 2018

(87) PCT Pub. No.: WO2017/219098

PCT Pub. Date: Dec. 28, 2017

(65) Prior Publication Data

US 2019/0185975 A1 Jun. 20, 2019

(30) Foreign Application Priority Data

Jun. 24, 2016 (AU) ..... 2016902490

(51) Int. Cl.
*C22C 37/08* (2006.01)
*C22C 33/04* (2006.01)
(Continued)

(52) U.S. Cl.
CPC ..... *C22C 37/08* (2013.01); *C22C 33/04* (2013.01); *C22C 33/08* (2013.01); *C22C 37/06* (2013.01);
(Continued)

(58) Field of Classification Search
CPC ..... C22C 33/00; C22C 33/08–12; C22C 37/00–10; C22C 33/10; C22C 37/06;
(Continued)

(56) References Cited

U.S. PATENT DOCUMENTS 3,834,950 A 9/1974 Feltz
3,961,994 A 6/1976 Thome
(Continued)

FOREIGN PATENT DOCUMENTS

AU 699301 B2 11/1998
CL 199600073 A 1/1997
(Continued)

OTHER PUBLICATIONS

Tang X H, et al., "Beneficial Effects of the Core Shell Structures of Primary Carbides in High-Cr (45 wt%) White Cast Irons On Their Mechanical Behavior and Weir Resistance," Tribology Letters, Baltzer Science Publishers, NL; vol. 56, No. 3, Apr. 2015; pp. 1-10.
(Continued)

*Primary Examiner* — Keith Walker
*Assistant Examiner* — Adil A. Siddiqui
(74) *Attorney, Agent, or Firm* — Morriss O'Bryant Compagni Cannon, PLLC

(57) ABSTRACT

A casting of a hypereutectic white iron that, in an as-cast form of the casting, has a microstructure that includes a ferrous matrix that contains 12-20 wt. % chromium in solution in the matrix, eutectic chromium carbides dispersed in the matrix, primary chromium carbides dispersed in the matrix, and optionally secondary carbides dispersed in the matrix. The eutectic carbides are 15-25 vol. % of the casting and the primary carbides are 25-35 vol. % of the casting. When present, the secondary carbides are up to 6 vol. % of the casting.

10 Claims, 3 Drawing Sheets

(51) Int. Cl.

| | |
|---|---|
| ***C22C 33/08*** | (2006.01) |
| ***C22C 37/06*** | (2006.01) |
| ***C22C 38/04*** | (2006.01) |
| ***C22C 38/58*** | (2006.01) |
| ***C22C 38/08*** | (2006.01) |
| ***C22C 38/36*** | (2006.01) |
| ***C22C 38/40*** | (2006.01) |
| ***C22C 38/56*** | (2006.01) |
| ***C22C 38/18*** | (2006.01) |
| ***C22C 38/38*** | (2006.01) |

(52) U.S. Cl.
CPC ..... *C22C 38/04* (2013.01); *C22C 38/08* (2013.01); *C22C 38/18* (2013.01); *C22C 38/36* (2013.01); *C22C 38/38* (2013.01); *C22C 38/40* (2013.01); *C22C 38/56* (2013.01); *C22C 38/58* (2013.01)

(58) Field of Classification Search
CPC ..... C22C 37/08; C22C 33/04; C22C 38/04; C22C 38/08; C22C 38/18; C22C 38/36; C22C 38/38; C22C 38/40; C22C 38/56; C22C 38/58
See application file for complete search history.

(56) References Cited

U.S. PATENT DOCUMENTS

| | | | | |
|---|---|---|---|---|
| 4,043,842 | A | 8/1977 | Joiret | |
| 5,803,152 | A * | 9/1998 | Dolman | C22C 37/06 164/57.1 |
| 9,273,385 | B2 | 3/2016 | Dolman | |
| 9,284,631 | B2 | 3/2016 | Radon | |
| 9,580,777 | B1 | 2/2017 | Radon et al. | |
| 2010/0080727 | A1 * | 4/2010 | Powell | C22C 37/10 420/11 |
| 2013/0037179 | A1 * | 2/2013 | Dolman | C22C 37/06 148/542 |

FOREIGN PATENT DOCUMENTS

| | | | | |
|---|---|---|---|---|
| CN | 102330016 | A | 1/2012 | |
| CN | 102925783 | A | 2/2013 | |
| CN | 105441784 | A | 3/2016 | |
| GB | 1390011 | A | 4/1975 | |
| WO | 1984004760 | A1 | 12/1984 | |
| WO | WO-8404760 | A1 * | 12/1984 | B23K 35/308 |
| WO | 2004104253 | A1 | 12/2004 | |
| WO | 2011091479 | A1 | 8/2011 | |

OTHER PUBLICATIONS

Yang, Xiong, et al., "Structure and Performances of A Hypereutectic Super High Chromium Cast Iron Alloy," Jr. of Henan Univ. of Science and Technology, Natural Science, vol. 29, No. 3, Jun. 30, 2008 (with English Abstract).

Yang, Cheng-Kai, et al., "Effect of Carbon Contents on Microstructure and Wear Resistance of the Hypereutectic High Chromium Cast Iron," FOUNDARY, vol. 61, No. 12 (Dec. 31, 2012); pp. 1393-1394 (with English Abstract).

* cited by examiner

EROSION AND CORROSION RESISTANT WHITE CAST IRONS

TECHNICAL FIELD

The present invention relates to abrasion, impact, erosion and corrosion resistant white cast iron alloys comprising hard material dispersed in a host metal or metal alloy.

The present invention also relates to equipment used in the mining and mineral processing industries, such as pump components (including components for slurry pumps), that include castings of wear resistant materials or facings of white cast irons where the equipment is exposed to any one or more than one of severe abrasion, impact, erosion and corrosion wear.

The present invention also relates to a method of forming white cast iron alloys.

The present invention also relates to a method of forming castings or facings of white cast irons as at least a part of equipment used in the mining and mineral processing industries.

BACKGROUND

Equipment used in the mining and mineral processing industries often is subject to any one or more than one of severe abrasion, impact, erosion and corrosion wear.

The equipment includes, for example, slurry pumps and pipelines, mill liners, crushers, transfer chutes and ground-engaging tools.

By way of particular example, metal "wet-end" components in slurry pumps are subject to abrasion, impact, erosion and corrosion wear in service due to the passage of high tonnages of hard, sharp mineral particles through the pumps. The pump components include frame plate liners, impellers, volutes and throat bushes. Typically, the components range in size from 2 kilograms up to approximately 20 or more tonnes in mass. The components include castings of wear resistant materials or facings of wear resistant materials where the equipment is subject to any one or more than one of severe abrasion, impact, erosion and corrosion wear and require replacement at periodic intervals to maintain pump performance in service.

Material loss in the slurry pump metal wet-end components in service can be attributed to one or more of the following mechanisms:

Erosive wear by mineral particles (nominally 0.1-100 mm in diameter) flowing through the equipment.

Corrosion as a consequence of contact with liquids (which term includes slurries) flowing through the pumps, where the pH of the liquids can vary from very acidic to very basic.

Spalling or cracking due to impact loading in service.

A family of high chromium white cast irons (HCWCIs) described in International Standards Association ISO 21988, Sections 1 c) and 3.3 provides a range of alloys that optimise the three major properties of (a) wear resistance, (b) corrosion resistance and (c) fracture toughness that are required for slurry pump wet-end components in a wide range of operating conditions.

The first HCWCI was developed 100 years ago and patented in 1917 (U.S. Pat. No. 1,245,552).

The nominal bulk chemistry of the first HCWCI alloy is:

Chromium: 20-35 wt. %.

Carbon: 1.5-3.0 wt. %.

Silicon: 0.0-3.0 wt. %.

Iron: balance.

The first HCWCI alloy, designated as "Cr27" in Table 3 of International Standards Association ISO 21988 and referred to hereinafter as "Cr27", complies with the U.S. Pat. No. 1,245,552 claims and is essentially the "workhorse" material used today in many slurry pump applications that are subject to abrasion, erosion and corrosion wear.

The microstructure of castings of Cr27 alloy consists of two distinct phases, namely:

25 volume % of chromium carbides.

75 volume % ferrous matrix.

The hardness of the chromium carbides (1400-1600 HV) in the microstructure is greater than the hardness of the most common wear medium passing through slurry pumps, i.e. silica sand (900-1200 HV), and these carbides impart excellent wear resistance to the Cr27 castings.

The microanalyses of the chromium carbide and ferrous matrix phases and the bulk chemistries of the phases in Cr27 castings in the as-cast form of the castings, i.e. after the castings have been formed in moulds and cooled continuously to ambient temperature, are illustrated in Table 1 set out below.

TABLE 1

| Cr27 castings | | | | | | |
|---|---|---|---|---|---|---|
| Phase | Vol. | Chemistry (weight %) | | | | |
| Description | % | Cr | C | Mn | Si | Fe |
| Cr carbides | 25 | 62 | 8.8 | 2.0 | 0.0 | 27.2 |
| Ferrous matrix | 75 | 15 | 0.8 | 2.0 | 0.7 | 81.5 |
| Total (bulk) | 100 | 27 | 2.8 | 2.0 | 0.5 | 67.7 |

The following discussion of Cr27 castings is in the context of the as-cast form of the castings.

The chemistry of the chromium carbides in Cr27 castings is Fe—62 Cr—8.8 C—2 Mn and the stoichiometry is $(Cr,Fe,Mn)_7C_3$ The presence of the hard chromium carbide phase in the microstructure of Cr27 castings imparts increased wear resistance to the castings.

The chemistry of the ferrous matrix phase in Cr27 castings is Fe—15 Cr—0.8 C—2 Mn—0.5 Si, which is essentially a martensitic stainless steel (hardness 600-800 HV) and provides good corrosion resistance in aqueous environments when pH>4.5.

The chromium carbides in the microstructure of Cr27 castings include a three dimensional continuous network which embrittles Cr27 and make the castings vulnerable to impact loading conditions in service. As a consequence of the presence of the 3-D continuous network, Cr27 castings have low to moderate fracture toughness.

The liquidus temperature for Cr27 alloy is less than 1300° C. and is much easier to cast in the foundry than steels where liquidus temperatures are higher, typically about 1500° C.

Wear resistance of Cr27 castings is achieved by the presence of 25 vol. % chromium carbides (CrC).

Corrosion resistance of Cr27 castings is achieved by the presence of 75 vol. % stainless steel ferrous matrix containing 15 wt. % of elemental chromium in solution.

There have been further developments in the field of high chromium white cast irons since the above-described first HCWCI was developed about 100 years ago. These developments have resulted in improvements in performance in a number of areas.

By way of example, a family of HCWCI, designated Cr35, was developed by the applicant to produce slurry pump parts to satisfy a number of high wear applications.

Cr35 was adopted by the Australian Standards Association and the International Standards Association as a designated wear resistant material and was incorporated in AS/NZS 2027 and ISO 21988, respectively, about 10 years ago.

The wear resistance of the Cr35 family of alloys is recognised as superior to that of Cr27 alloy in many slurry pump applications where erosive wear is the dominant mode of material loss.

The applicant has realised that there is still a need for further improvements in some applications, including slurry pump applications (and for other equipment in a range of other applications).

One particular area for improvement is slurry pump applications where a pH<4.5 due to the presence of acids and/or aeration and corrosion is the dominant factor in service life.

The above description should not be taken to be an admission of the common general knowledge in Australia or elsewhere.

SUMMARY OF THE DISCLOSURE

An experimental project was carried out by the applicant to establish the factors contributing to the performance of HCWCI slurry pump wet-end components in corrosive applications.

The aim of the experimental project was to determine the optimum microstructure of HCWCI castings to achieve suitable performance in environments where there is severe abrasive, impact and erosive wear and that is highly corrosive.

One outcome of the experimental project is a realisation that cast HCWCI slurry pump wet-end components that have a particular microstructure can perform well in severe abrasive, impact, erosive and corrosive applications.

The microstructure of the invention is defined in this specification in two states. One state is the microstructure in the as-cast form of the casting. The other state is the microstructure in the end-use form of the casting.

Typically, the end-use form of a casting is a heat treated as-cast casting. Typically, the heat treatment increases the amount of chromium carbides and decreases the amount of elemental chromium in solution in the matrix of the casting. It is noted that there are situations where the end-use form of a casting is the as-cast casting.

In general terms, based on the results of the experimental project, the invention provides a casting of a hypereutectic white iron that, in the as-cast form of the casting, has a microstructure that includes a ferrous matrix that contains 12-20 wt. % chromium in solution in the matrix, eutectic chromium carbides dispersed in the matrix, primary chromium carbides dispersed in the matrix, and optionally secondary carbides dispersed in the matrix, where the eutectic carbides are 15-25 vol. % of the casting, the primary carbides are 25-35 vol. % of the casting, and when present, the secondary carbides are up to 6 vol. % of the casting.

The as-cast casting of the invention described in the preceding paragraph has a combination of the following features that provide suitable performance in applications where components are exposed to environments where there is severe abrasive, impact and erosive wear and that is highly corrosive, such as for HCWCI slurry pump wet-end components:

(a) a high, at least 12 wt. %, chromium in solution in the matrix;

(b) a combination of eutectic carbides and primary chromium carbides dispersed in the matrix; and (c) a high, typically at least 45 vol. %, combined amount of eutectic carbides and primary chromium carbides.

The term "primary carbides" is understood to mean carbides that precipitate from a melt between the liquidus and solidus temperatures.

The term "eutectic carbides" is understood to mean carbides that precipitate from a melt at the solidus temperature.

The term "secondary carbides" is understood to mean carbides that form via solid-state reactions in castings.

The reference to "as-cast form of the casting" in the preceding paragraph (and as used in the earlier part of the specification) is understood to mean the casting at the point the casting is formed and cooled continuously in a mould to ambient temperature. The cooling time could be minutes for smaller castings and several weeks for larger castings. Typically, the castings could be 1 or 2 kilograms and up to approximately 20 tonnes in mass.

The term "as-cast form of the casting" does not extend to castings that have been subjected to after-casting heat treatments, for example that result in precipitation of secondary chromium carbides. One example of a secondary chromium carbide heat treatment includes heating castings to 950-1050° C. and holding the castings at temperature for 4-6 hours and air cooling the castings to ambient temperature. The secondary chromium carbide heat treatment procedure precipitates Cr and C and other elements from solution in the matrix and therefore changes the concentration of elements in solution in the matrix. In the context of Cr, the reduction in elemental Cr in solution in the matrix of a heat treated casting as a consequence of a secondary chromium carbide heat treatment procedure may be up to 5 wt. % depending on the prior thermal history of the casting and the final heat treatment procedure.

Compared to the above-described microstructure of the as-cast casting, a heat treated as-cast casting may include (a) a lower concentration of chromium in solution, (b) a lower volume of the matrix; (c) the same concentrations of primary and eutectic carbides, and (d) a higher volume of secondary carbides.

The concentration of chromium in solution in the heat treated casting may be at least 12 wt. %.

The concentration of chromium in solution in the heat treated casting may be at least 14 wt. %.

The concentration of chromium in solution in the heat treated casting may be less than 20 wt. %.

Typically, the weight ratio of the elemental chromium and carbon in the as-cast casting and the heat treated casting is selected to optimise the formation of "hard" carbides as the eutectic carbides, the primary carbides, and the secondary carbides in the as-cast casting and the heat treated casting.

The term "hard" is a relative term. In the context of the invention the skilled person has a clear view on what constitutes a hard carbide. For example, the skilled person understands that "hard" carbides include $M_7C_3$ carbides (where "M" comprises Cr, Fe, and Mn). By comparison, $M_7C_3$ carbides are harder than $M_{23}C_6$ carbides and $M_{23}C_6$ carbides are considered to be "soft" carbides.

In this context, the applicant is aware that as the chromium concentration increases in the hypereutectic white cast iron alloys of the invention, i.e in the bulk chemistry of the alloy from which the casting is formed, the carbides have a propensity to transform/form as a softer phase of $M_{23}C_6$ carbides, rather than as harder phase of $M_7C_3$ carbides.

Where optimal hardness is required, it is preferable that the weight ratio of the chromium and carbon in the as-cast casting and the heat treated casting be greater than 7:1 and less than 9.25:1.

Typically, the ratio of the chromium and carbon in the as-cast casting and the heat treated casting is greater than 7.5:1.

The ratio of the chromium and carbon in the as-cast casting and the heat treated casting may be greater than 8:1.

The eutectic carbides, the primary carbides, and the secondary carbides in the as-cast casting and the heat treated casting may be $M_7C_3$ carbides (where "M" comprises Cr, Fe, and Mn).

The eutectic $(Cr,Fe,Mn)_7C_3$ carbides and the primary $(Cr,Fe,Mn)_7C_3$ carbides in the as-cast casting and the heat treated casting may each comprise: Cr: 50-70 wt. %, C: 8.5-8.9 wt. %, and Mn: 0.5-5.0 wt. % and other elements, and balance Fe.

The eutectic $(Cr,Fe,Mn)_7C_3$ carbides and the primary $(Cr,Fe,Mn)_7C_3$ carbides in the as-cast casting and the heat treated casting may each comprise: Cr: 55-65 wt. %, C: 8.5-8.9 wt. %, and Mn: 0.5-5.0 wt. % and other elements, and balance Fe.

The eutectic carbides in the as-cast casting and the heat treated casting may be fine-grained carbides, for example similar to the chromium carbides in Cr27 castings.

The primary carbides in the as-cast casting and the heat treated casting may be coarse-grained carbides.

The secondary $(Cr,Fe,Mn)_7C_3$ carbides in the as-cast casting and the heat treated casting may comprise: Cr: 45 wt. %, C: 9 wt. %, and Mn: 4 wt. % and other elements, and balance Fe.

The secondary carbides in the as-cast casting and the heat treated casting may be fine-grained carbides.

The ferrous matrix in the as-cast casting may comprise: Cr: 12-20 wt. %, C: 0.2-1.5 wt. %, and Mn: 1.0-5.0 wt. %, and balance Fe.

The ferrous matrix in the as-cast casting may comprise: Cr: 14-16 wt. %, C: 0.3-1.2 wt. %, and Mn: 1.0-5.0 wt. %, and balance Fe.

The ferrous matrix in the as-cast casting may comprise 13-17 wt. % Cr in solution in the matrix.

The ferrous matrix in the as-cast casting may comprise 15 wt. % Cr in solution in the matrix.

The as-cast casting may comprise 25-30 vol. % primary carbides, 15-20 vol. % eutectic carbides, and up to 6 vol. % secondary carbides.

Typically, the as-cast casting comprises 25-28 vol. % primary carbides, 17-20 vol. % eutectic carbides, and up to 6 vol. % secondary carbides.

The combined amount of eutectic carbides and primary chromium carbides in the as-cast casting may be greater than 45 vol. %.

The combined amount of eutectic carbides and primary chromium carbides in the as-cast casting may be greater than 50 vol. %.

The combined amount of eutectic carbides and primary chromium carbides in the as-cast casting may be less than 55 vol. %.

The as-cast casting may comprise at least 2 vol. % secondary carbides.

The ferrous matrix of the as-cast casting may be substantially martensite.

The ferrous matrix of the as-cast casting may consist of martensite and some retained austenite.

The ferrous matrix of the heat treated casting may consist of martensite.

The casting may be at least 1 tonne.

The casting may be at least 2 tonnes.

The casting may be at least 3 tonnes.

The casting may be manufactured by inoculation casting as described, by way of example, in Australian patent 698777 in the name of the applicant, and the disclosure in the patent is incorporated herein by cross-reference.

The bulk chemistry of the as-cast casting and the heat treated casting may be: 35-40 wt. % Cr, 4-5 wt. % C, <4 wt. % Mn, <1.5% Si, and balance Fe and impurities.

The weight ratio of the chromium and carbon of the bulk chemistry may be greater than 7:1 and less than 9.25:1.

The C concentration of the bulk chemistry may be greater than 4.3 wt. %.

The C concentration of the bulk chemistry may be less than 4.7 wt. %.

The Mn concentration of the bulk chemistry may be greater than 1 wt. %.

The Mn concentration of the bulk chemistry may be less than 3 wt. %.

The Si concentration of the bulk chemistry may be greater than 0.5 wt. %.

The Si concentration of the bulk chemistry may be less than 1 wt. %.

The impurities may include sulphur, phosphorus, aluminum, nickel, copper, and molybdenum.

In some situations, depending on foundry practices, the concentrations of the impurities may be quite high. For example, the concentration of Ni may be up to 2 wt. % in some situations. It is noted that at these concentrations, Ni does affect the hardness of the ferrous matrix, because Ni is a strong austenite stabilizer, and affect the phase transformation from austenite to martensite. However, because Ni cannot enter the chromium carbides, and all of the Ni remains in the ferrous matrix, it has very little effect on the material microstructure at these concentrations. It is preferable that the Ni concentration is less than 2.5 wt. %.

The bulk chemistry of the as-cast casting and the heat treated casting may include positive additions of any one or more of the compounds: carbides and/or nitrides and/or borides of niobium, titanium, tungsten, molybdenum, tantalum, vanadium and zirconium.

The wear resistance of the casting may be selected as required having regard to the end-use application of the casting. Wear resistance is not a material property. Wear resistance is a system property and depends on a number of operating factors, e.g. in the case of pumps conveying slurries, the hardness of slurry particles, the size and angularity of slurry particles, slurry velocity, and slurry pH, etc.

Similarly, the corrosion resistance of the casting may be selected as required having regard to the end-use application of the casting. Corrosion resistance is not a material property and, as is the case with wear resistance, depends on a number of operating factors.

The fracture toughness of the casting may be in a range of 20-40 $MPa \cdot m^{1/2}$ as determined by the testing procedure described in ASTM STP 559. The disclosure in ASTM STP 559 is incorporated herein by cross-reference.

The invention also comprises equipment used in the mining and mineral processing industries, such as pump components, that includes the above-described casting where the equipment is exposed to any one or more than one of severe abrasion, erosion and corrosion wear.

The equipment may comprise the casting in a heat treated form, wherein as a consequence of the heat treatment, the microstructure has (a) a lower concentration of chromium in solution, (b) a lower volume of the matrix, (c) the same concentrations of primary and eutectic carbides; and (d) a higher volume of the secondary carbides.

The concentration of chromium in solution in the heat treated casting may be at least 12 wt. %.

The concentration of chromium in solution in the heat treated casting may be at least 14 wt. %.

The concentration of chromium in solution in the heat treated casting may be less than 20 wt. %.

As noted above, equipment of particular interest to the applicant is "wet-end" components in mill circuit slurry pumps.

The equipment may also include, for example, pipelines, mill liners, crushers, transfer chutes and ground-engaging tools.

The invention also provides a method of producing the above-described casting that includes the steps of:

(a) forming a melt of a high chromium white cast iron alloy;

(b) pouring the molten alloy into a mould and forming a casting of a hypereutectic white iron having a microstructure that includes a ferrous matrix that contains 12-20 wt. % chromium in solution, eutectic chromium carbides dispersed in the matrix, and primary chromium carbides dispersed in the matrix, and optionally secondary carbides dispersed in the matrix, where the eutectic carbides are 15-25 vol. % of the casting, the primary carbides are 25-35 vol. % of the casting, and when present, the secondary carbides are up to 6 vol. % of the casting in the as-cast form of the casting.

The method may be an inoculation casting method as described, by way of example, in Australian patent 698777 in the name of the applicant.

The method may include an after-casting heat treatment step.

The heat treatment step may include heating the casting to 950-1050° C. and holding the casting at temperature for 4-6 hours and air cooling the casting to ambient temperature.

The invention also comprises a white cast iron alloy having the following bulk chemistry: 35-40 wt. % Cr, 4-5 wt. % C, <4 wt. % Mn, <1.5% Si, and balance Fe and impurities.

The weight ratio of the Cr and C may be greater than 7:1 and less than 9.25:1.

Typically, the ratio of the Cr and C is greater than 7.5:1.

The ratio of the Cr and C may be greater than 8:1.

The C concentration of the bulk chemistry may be greater than 4.3 wt. %.

The C concentration of the bulk chemistry may be less than 4.7 wt. %.

The Mn concentration of the bulk chemistry may be greater than 1 wt. %.

The Mn concentration of the bulk chemistry may be less than 3 wt. %.

The Si concentration of the bulk chemistry may be greater than 0.5 wt. %.

The Si concentration of the bulk chemistry may be less than 1 wt. %.

The impurities may include sulphur, phosphorus, aluminum, nickel, copper, and molybdenum.

BRIEF DESCRIPTION OF THE DRAWING

Embodiments of the invention are now described, by way of example only, with reference to the following Figures, of which.

DETAILED DESCRIPTION OF EMBODIMENTS

As noted above, the experimental project carried out by the applicant found that HCWCI slurry pump wet-end components made from an experimental alloy having (a) a chromium carbide content of the order of 45 vol. % and (b) a ferrous matrix containing a chromium content of the order of 15 wt. % in solution in the matrix in the as-cast form of the casting, performed well in severe abrasive, impact, erosive and corrosive applications.

On the basis of the experimental project, the applicant has realised that as-cast castings having a combination of the following features provide suitable performance as HCWCI slurry pump wet-end components exposed to environments where there is severe abrasive, impact and erosive wear and that is highly corrosive:

(a) a high, at least 12 wt. %, chromium in solution in the matrix;

(b) a combination of eutectic carbides and primary chromium carbides dispersed in the matrix; and (c) a high, typically at least 45 vol. %, combined amount of eutectic carbides and primary chromium carbides.

In addition, the applicant has realised that as-cast castings having the following microstructure have an optimized combination of improved toughness, good corrosion resistance, and excellent wear resistance for a range of applications, including "wet-end" components in mill circuit slurry pumps, pipelines, mill liners, crushers, transfer chutes and ground-engaging tools:

(a) a ferrous matrix that contains 12-20 wt. % chromium in solution, (b) 15-25 vol. % of the casting comprising eutectic chromium carbides dispersed in the matrix, (c) 25-35 vol. % of the casting comprising primary chromium carbides dispersed in the matrix, and (d) optionally, up to 6 vol. % of the casting comprising secondary carbides dispersed in the matrix.

Figure 1:
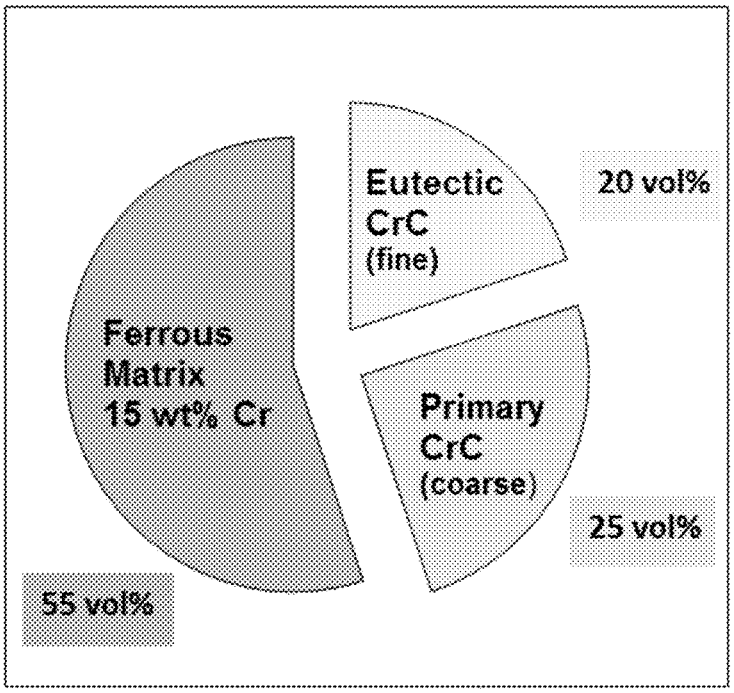
FIG. 1 which is a pie chart that illustrates the phases of one alloy casting in accordance with the invention produced and analysed during the above-mentioned experimental program carried out by the applicant.

The microstructure of the experimental alloy in the as-cast form, i.e. prior to any downstream after-casting treatment, is illustrated diagrammatically in the pie chart of FIG. 1.

With reference to FIG. 1, the microstructure comprises:

A ferrous matrix consisting of martensite and some retained austenite and 15 wt. % chromium in solution in the matrix, with the ferrous matrix making up 55 vol. % of the casting.

Fine, continuous 3-D network of eutectic chromium carbides similar to the chromium carbides in Cr27 (20 vol. %) casting making up 20 vol. % of the casting. The presence of the continuous, 3-D network of eutectic chromium carbides in the microstructure of Cr27 casting substantially reduces the fracture toughness. The eutectic carbides are $M_7C_3$ carbides (where "M" comprises Cr, Fe, and Mn).

Coarse, discrete primary chromium carbides making up 25 vol. % of the casting that formed during solidification and also adversely influence the fracture toughness of the casting by decreasing the amount of the tougher ferrous matrix in the microstructure. The primary carbides are $M_7C_3$ carbides (where "M" comprises Cr, Fe, and Mn).

Optionally, fine, discrete secondary carbides making up to 6 vol. % of the casting that formed after solidification and also adversely influence the fracture toughness of the casting by (a) decreasing the amount of the tougher ferrous matrix in the microstructure and (b) destabilizing the austenite phase which decomposes to martensite. The secondary carbides are $M_7C_3$ carbides (where "M" comprises Cr, Fe, and Mn).

Figure 2:
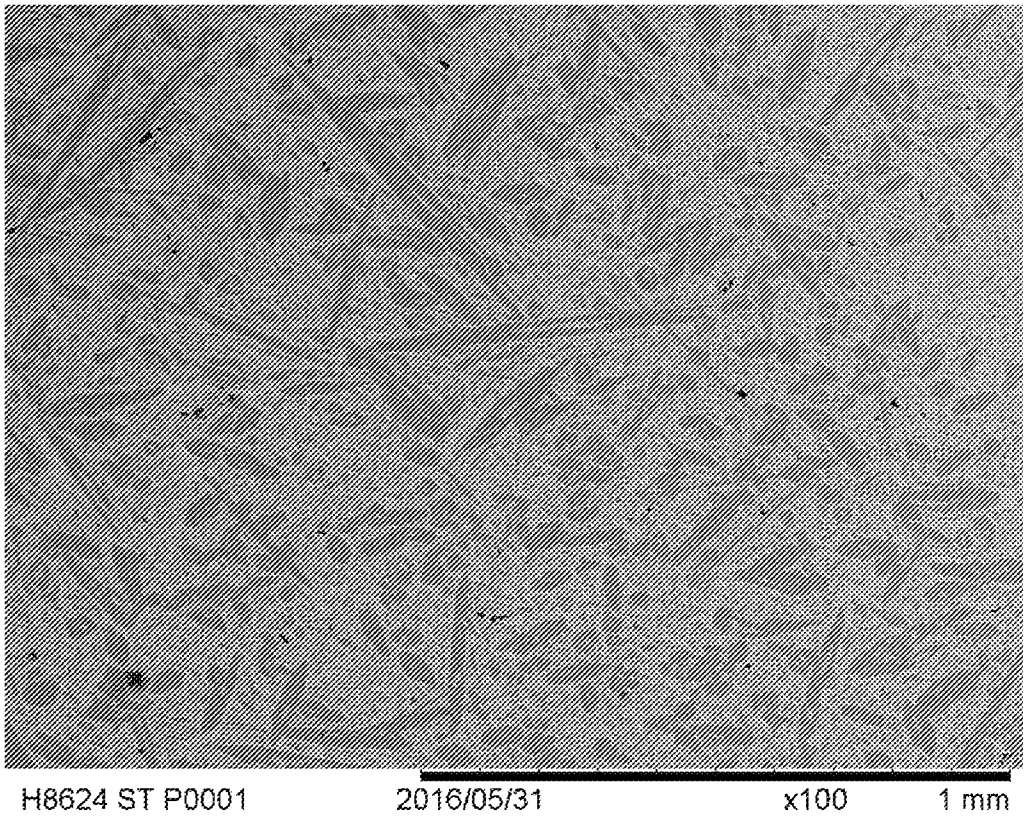
FIG. 2 is a representative SEM image of a sample as-cast and heat treated casting in accordance with the invention.

FIG. 2 is a representative SEM image of a sample as-cast and heat treated casting in accordance with the invention. The image has been marked-up to show the distribution of primary and eutectic carbides in the ferrous matrix.

In nominal Fe—Cr—C alloys, the microstructural and micro-analytical features of stoichiometry of the $(Cr,Fe,Mn)_7C_3$ carbides, the vol. % of primary carbides, the vol. % of eutectic carbides, the carbide distribution, and the amounts of elemental chromium, iron, and carbon in (a) the carbides and (b) the ferrous matrix of castings of the alloys are greatly dependent on the partitioning behaviour of each individual element in the alloy during the solidification and cooling processes to form the castings.

The factors determining the partitioning coefficients for each element are complex and not accurately known and must be established by "trial and error".

In the experimental project the applicant produced a number of Fe—Cr—C—2 Mn—0.5 Si alloys in the laboratory and the resultant microstructures and microanalyses of the various phases were determined by a detailed examination using Scanning Electron Microscopy, Energy-Dispersive Spectroscopy, Wavelength-Dispersive Spectroscopy and X-Ray Diffraction.

From this experimental data, the applicant was able to establish alloys with microstructural features similar to (or close to) the selected requirements for the three phases in the casting as shown in FIG. 1, with particular focus on working towards the requirements for 15 wt. % chromium in solution in the matrix, the ferrous matrix making up 55 vol. % of the casting, and the eutectic and primary carbides each making up 20 and 25 vol. %, respectively, of the casting.

The nominal bulk chemistry of the casting having the microstructural features described in the preceding paragraph was determined by summing the microanalyses and proportions of each phase. A typical nominal bulk chemistry for an example casting with selected microstructural features in accordance with the invention is shown in Table 2 below.

TABLE 2

Nominal chemistry of an example casting with selected microstructural features.

| | | Composition (wt. %) | | | | | |
|---|---|---|---|---|---|---|---|
| Phases | Vol. % | Fe | Cr | C | Mn | Si | sum |
| Primary Carbide | 28.00 | 29.20 | 60.00 | 8.80 | 2.00 | 0.00 | 100 |
| Eutectic Carbide | 20.00 | 33.20 | 55.00 | 8.80 | 3.00 | 0.00 | 100 |
| Ferrous Matrix | 52.00 | 80.40 | 15.00 | 0.600 | 3.00 | 1.00 | 100 |
| Total | 100 | 56.62 | 35.60 | 4.54 | 2.72 | 0.52 | 100 |

The applicant followed the following steps in the selection process:

Selecting 25 vol. % primary carbides for the casting fixed the eutectic carbides at approximately 20 vol. % and the ferrous matrix at approximately 55 vol. % of the casting.

Selecting the chemistry of the ferrous matrix in the casting to be Fe-15 Cr—0.8 C—2 Mn—0.7 Si fixed the bulk carbon content of the alloy.

The bulk carbon content of the alloy established the solidification parameters (liquidus and solidus temperatures for the alloy. The liquidus temperature, in turn, determined the final amount of primary carbides in the microstructure.

Using the data in Table 2 as a starting point to produce a trial casting, the microstructural features of the trial casting were quantified and compared to the desired features in Table 2.

By a process of iteration, fine adjustments to the bulk chemistry of successive castings were made to establish the final bulk chemistry exhibiting the desired microstructural features of FIG. 1, and as exemplified in FIG. 2.

With regard to the last dot point, determining the required bulk chemistry to produce samples with a ferrous matrix containing a chromium content of the order of 15 wt. % in solution in the matrix at ambient temperature required an assessment to be made of the chromium content prior to cooling to ambient temperature. Noting that direct measurement at temperature is not possible, the measurements were made by solution treating the samples at 1200° C. followed by water quenching to ambient temperature. This treatment retained the chromium in solution, and the maximum elemental chromium content achievable in the ferrous matrix in the as-cast condition could then be determined.

In addition to the above mentioned experimental project, the applicant has produced a number of castings in accordance with the invention and tested these casting in field trials, some of which have been completed and assessed.

The castings were produced in accordance with standard procedure of the applicant for high chromium white cast irons. The procedure is an inoculation process described in a patent family that includes U.S. Pat. No. 5,803,152. The disclosure in the US patent is incorporated herein by cross-reference. The castings were produced from 1-3 tonne heats of selected bulk chemistries. Pouring temperatures were in the range of 1350 to 1450° C. The castings were allowed to cool naturally in their moulds. The castings were heat treated depending on the specific field trial application.

One of the series of field trials was carried out on impeller and throatbush components of a 150 MCU pump of the applicant in a mill circuit of a mining company operation. The trial ran for 1766 hours and wear rate was assessed and compared to wear rates for a high chromium white cast iron currently used in the same type of pump in the same mill circuit.

Another of the series of trials was carried out on impeller, throatbush, frame plate liners, and volute components of a 350 MCU pump of the applicant in a mill circuit of another mining company operation. The trial ran for 4100 hours and wear rate was assessed and compared to wear rates for a high chromium white cast iron currently used in the same type of pump in the same mill circuit.

The wet chemical analysis of the bulk chemistry used to form the castings in one of the field trials is set out below in Table 3.

TABLE 3

| Wet Chemical analysis | | | | | | |
|---|---|---|---|---|---|---|
| Element | Cr | C | Mn | Ni | Si | Fe |
| Wt. % | 37.5 | 4.4 | 2.0 | 1.7 | 0.43 | Bal. |

The analysis was carried out on inoculated samples and, therefore, there would have been approximately 1 wt. % less chromium and approximately 0.1 wt. % less carbon in the original casting.

Figure 3:
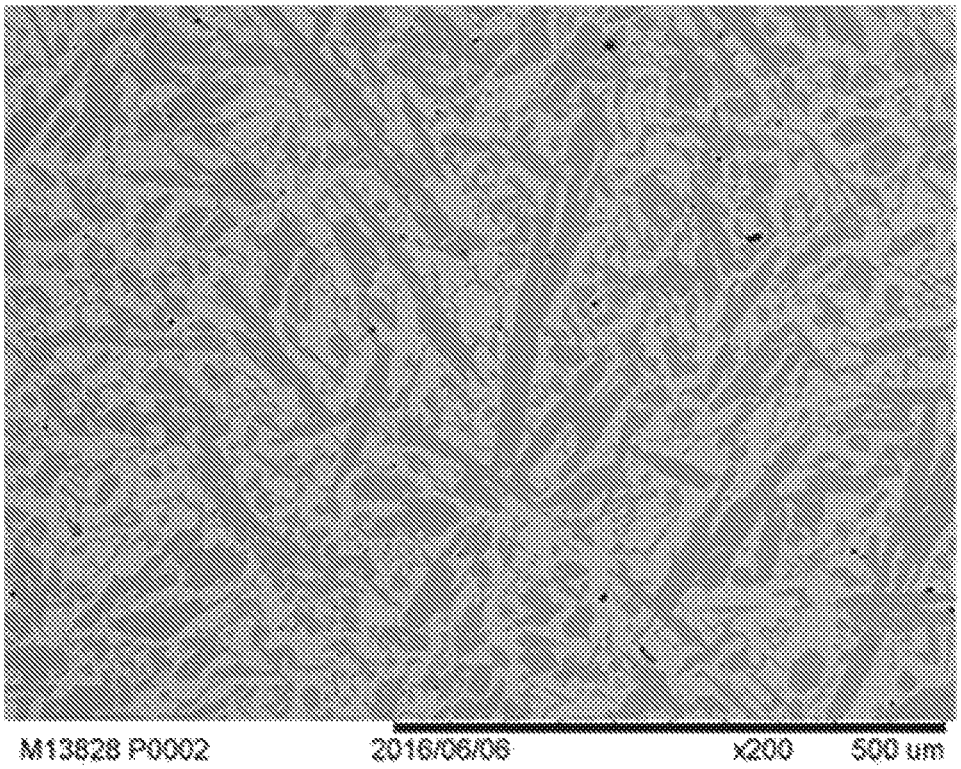
FIG. 3 is a representative SEM image of a test cast in the same heat as a field trial of an as-cast casting in accordance with the invention.

FIG. 3 is a representative SEM image of a test cast in the same heat as the field trial produced from the bulk chemistry in Table 3. The image shows the distribution of primary and eutectic carbides in the ferrous matrix. By estimate, the test cast (and therefore the field trial castings) contained 18 vol. % of eutectic chromium carbides, 28 vol. % of primary carbides, 2-3 vol. % of secondary carbides, and 12-16 wt. % Cr in solution in the matrix.

It was found that the wear rate in the field trial was 0.3-0.4 mm/day. This is a 40% improvement over the high chromium white cast iron currently used in the same type of pump in the same mill circuit.

From a practical perspective, when casting actual products in moulds in a foundry, it will be necessary to take into account the impact of cooling conditions on the microstructure of castings and the extent to which chromium and other elements will precipitate from solution. In the context of chromium concentration, different amounts of chromium will precipitate out of solution as a casting in a mould cools to ambient temperature depending on the thermal profile of the mould and the size of the casting. It will be necessary to take this into account when determining a bulk chemistry required to result in a ferrous matrix containing a target chromium content of the order of 15 wt. % (or another target concentration) in solution in the matrix at ambient temperature.

In addition, it is noted that in standard foundry practice, castings of an alloy may be subjected to a further heat treatment procedure, for example, heating to 950-1050° C., holding at temperature for 4-6 hours, and air-cooling to ambient temperature. This heat treatment procedure hardens the ferrous matrix by 100-200 Brinell points due to:

(a) secondary hardening by the precipitation of secondary chromium carbides in the ferrous matrix, destabilisation of the retained austenite in the ferrous matrix; and (b) subsequent transformation of any Cr-depleted austenite to martensite in the ferrous matrix on cooling to room temperature.

It is estimated that the formation of secondary chromium carbide precipitates during such heat treatment at 950-1050° C. will reduce the elemental chromium content of the ferrous matrix in solution by up to 3 wt. %.

Many modifications may be made to the embodiments of the invention described in relation to the Figures without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A casting of a hypereutectic white iron that, in an as-cast form of the casting, has a microstructure that includes a ferrous matrix that contains 12-20 wt. % chromium in solution in the matrix, eutectic carbides dispersed in the matrix, primary carbides dispersed in the matrix, and optionally secondary carbides dispersed in the matrix, where the eutectic carbides are 15-25 vol. % of the casting, the primary carbides are 25-35 vol. % of the casting, and when present, the secondary carbides are up to 6 vol. % of the casting, wherein the ferrous matrix also comprises C: 0.2-1.5 wt. % and Mn: 1.0-5.0 wt. %;

wherein the eutectic carbides, the primary carbides, and the secondary carbides consist of $M_7C_3$ carbides, where "M" comprises Cr, Fe, and Mn;

wherein the weight ratio of chromium and carbon in the casting is greater than 8:1 and less than 9.25:1; and wherein the bulk chemistry of the casting comprises: >37-40 wt. % Cr, 4-5 wt. % C, 1-3 wt. % Mn, <1.5 wt. % Si, and balance Fe and impurities.

2. The casting defined in claim 1 wherein the eutectic $(Cr,Fe,Mn)_7C_3$ carbides and the primary $(Cr,Fe,Mn)_7C_3$ carbides each comprise: Cr: 50-70 wt. %, C: 8.5-8.9 wt. %, and Mn: 0.5-5.0 wt. %.

3. The casting defined in claim 1 wherein the ferrous matrix comprises: Cr: 14-16 wt. %, C: 0.3-1.2 wt. %, and Mn: 1.0-5.0 wt. %.

4. The casting defined in claim 1 wherein the ferrous matrix comprises 13-17 wt. % Cr in solution in the matrix.

5. The casting defined in claim 1 comprising 25-30 vol. % primary carbides, 15-20 vol. % eutectic carbides, and up to 6 vol. % secondary carbides.

6. The casting defined in claim 1 wherein the combined amount of eutectic carbides and primary carbides in the as-cast casting is greater than 35 vol. %.

7. The casting defined in claim 1 wherein the combined amount of eutectic carbides and primary carbides in the as-cast casting is less than 55 vol. %.

8. The casting defined in claim 1 wherein the ferrous matrix is martensite.

9. The casting defined in claim 1 wherein the bulk chemistry of the casting comprises less than 4.9 wt. % C.

10. The casting defined in claim 1 wherein the bulk chemistry of the casting comprises less than 4.7 wt. % C.

* * * * *